US008091997B2

(12) United States Patent
Edwards

(10) Patent No.: US 8,091,997 B2
(45) Date of Patent: Jan. 10, 2012

(54) SYSTEM WITH SECURITY DEVICE SEPARATE FROM INK TANK IN A PRINTER

(75) Inventor: Mark Joseph Edwards, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 539 days.

(21) Appl. No.: 12/342,878

(22) Filed: Dec. 23, 2008

(65) Prior Publication Data

US 2010/0157003 A1 Jun. 24, 2010

(51) Int. Cl.
*B41J 2/175* (2006.01)

(52) U.S. Cl. ..... 347/86; 347/85

(58) Field of Classification Search ..... 347/85, 347/86
See application file for complete search history.

*Primary Examiner* — Matthew Luu
*Assistant Examiner* — Lisa Solomon

(57) ABSTRACT

An ink tank security system on a printer includes an ink tank connection station having a cavity with a passage for insertion of at least one ink tank through the passage into the cavity to supply ink for printing operations by the printer and for removal of the ink tank through the passage from the cavity for replenishing with ink. A door is mounted adjacent to the passage for undergoing movement between displaced positions enabling or blocking movement of the ink tank through the passage to or from the cavity. A sensor adjacent to the door is adapted to sense movement of the door between the displaced positions. A security device separate from the ink tank is insertable into and removable from a control slot on the printer under the door to control re-use of the ink tank for replenishing the supply of ink.

5 Claims, 5 Drawing Sheets

SYSTEM WITH SECURITY DEVICE SEPARATE FROM INK TANK IN A PRINTER

CROSS REFERENCES TO RELATED APPLICATIONS

None.

BACKGROUND

1. Field of the Invention

The present invention relates generally to printers and, more particularly, to a system with a security device separate from an ink tank in a printer.

2. Description of the Related Art

A current approach with respect to security considerations in the case of off-carrier and on-carrier ink tanks for inkjet printer systems is to provide an integrated circuit (IC) as a security device and to fixedly attach it to the ink tanks, such as done in the prior art ink tank security system depicted in FIGS. 1-3. The security device of this prior art system sometimes provides a mechanism for preventing users from breaching the terms of a license or contract agreement with the product manufacturer.

However, as depicted in FIGS. 1 and 2, the approach of this prior art ink tank security system involves costly complications be undertaken for its implementation, arising from the fact that the security device is fixedly attached to the ink tank. One complication is the need for an IC connector to mate with the security device directly or via a printed circuit board (PCB) on which the security device resides. The use of such a connector has several tight tolerance constraints in design due to the fact that it must mate to the ink tank as it is loaded onto the printer. Typically, this security system will need to employ lengthy cabling to the security IC connectors. Another complication is the need to have the fixedly attached security device be removed from the ink tank and replaced when the ink tank is re-manufactured.

Thus, there is a need for an innovation providing the security desired while avoiding costly complications from fixedly attaching the security devices to the ink tanks.

SUMMARY OF THE INVENTION

The present invention meets this need by providing an innovation in the form of a system in which a similar security device is provided and is shipped with, but separate from, the ink tank. This separate security device, still in the form of an IC/PCB, provides the same means to limit users from refilling the ink tanks by shutting down printing after some maximum dot count is reached. However, this approach allows flexibility as to where to put the security device and results in cost savings through system simplification.

Accordingly, in an aspect of the present invention, an ink tank security system in a printer includes an ink tank connection station on the printer for insertion and removal of at least one ink tank, and a security device separate from the ink tank and insertable into and removable from a location on the printer to control re-use of the ink tank for replenishing the supply of ink for printing operations by the printer.

In another aspect of the present invention, an ink tank security system in a printer includes an ink tank connection station on the printer having a cavity with a passage to the cavity for insertion and removal of at least one ink tank, a door mounted adjacent to the passage to the cavity of the station for undergoing movement between first and second displaced positions opening and closing the passage to the cavity of the station, a sensor disposed adjacent to the door and adapted to sense movement of the door between the first and second displaced positions corresponding opening and closing the cavity of the station and to provide notification to the printer of the movement of the door, and a security device separate from the ink tank and being insertable into and removable from a location on the printer to control re-use of the ink tank for replenishing the supply of ink for printing operations by the printer.

BRIEF DESCRIPTION OF THE DRAWINGS

Figure 1:
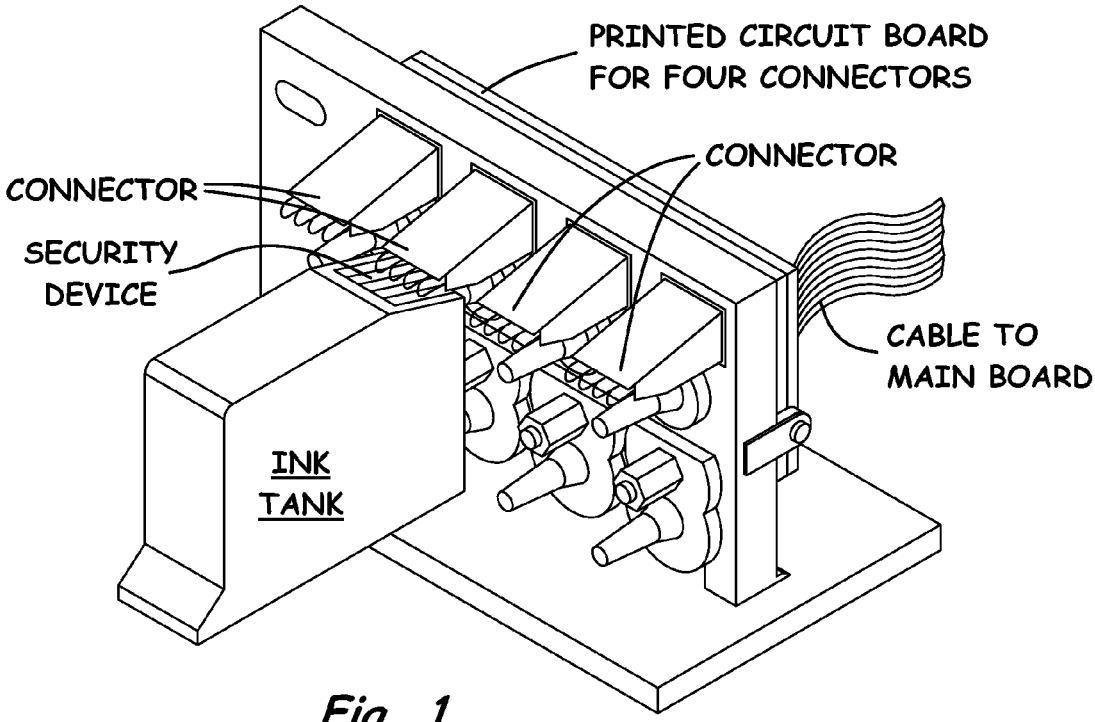
Fig. 1 (PRIOR ART)

Having thus described the invention in general terms, reference will now be made to the accompanying drawings, which are not necessarily drawn to scale and in some instances portions may be exaggerated in order to emphasize features of the invention, and wherein:

FIG. 1 is an exemplary embodiment of a prior art ink tank security system showing a single ink tank with a fixedly attached IC/PCB security device mated with one of multiple connectors on a mounting plate also supporting a printed circuit board for the multiple connectors and a cable for interconnecting the connectors and printed circuit board to a main printed circuit board.

Figure 2:
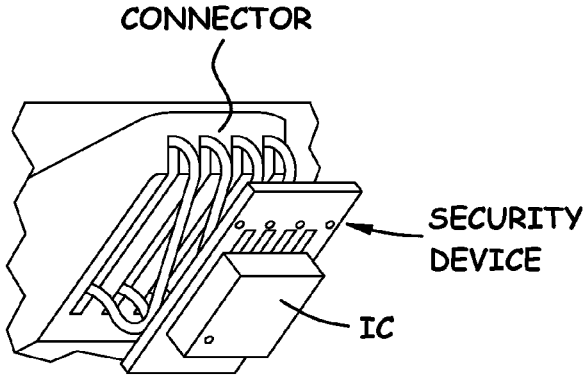
Fig. 2 (PRIOR ART)

FIG. 2 is a close-up view of the IC/PCB security device of FIG. 1, shown mating with the one connector and with the ink tank omitted to show a rear non-contact side of the security device.

Figure 3:
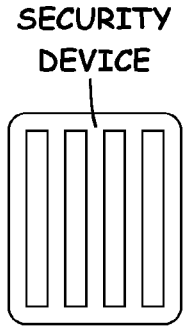
Fig. 3 (PRIOR ART)

FIG. 3 is a plan view of the contact side of the security device of FIGS. 1 and 2.

Figure 4:
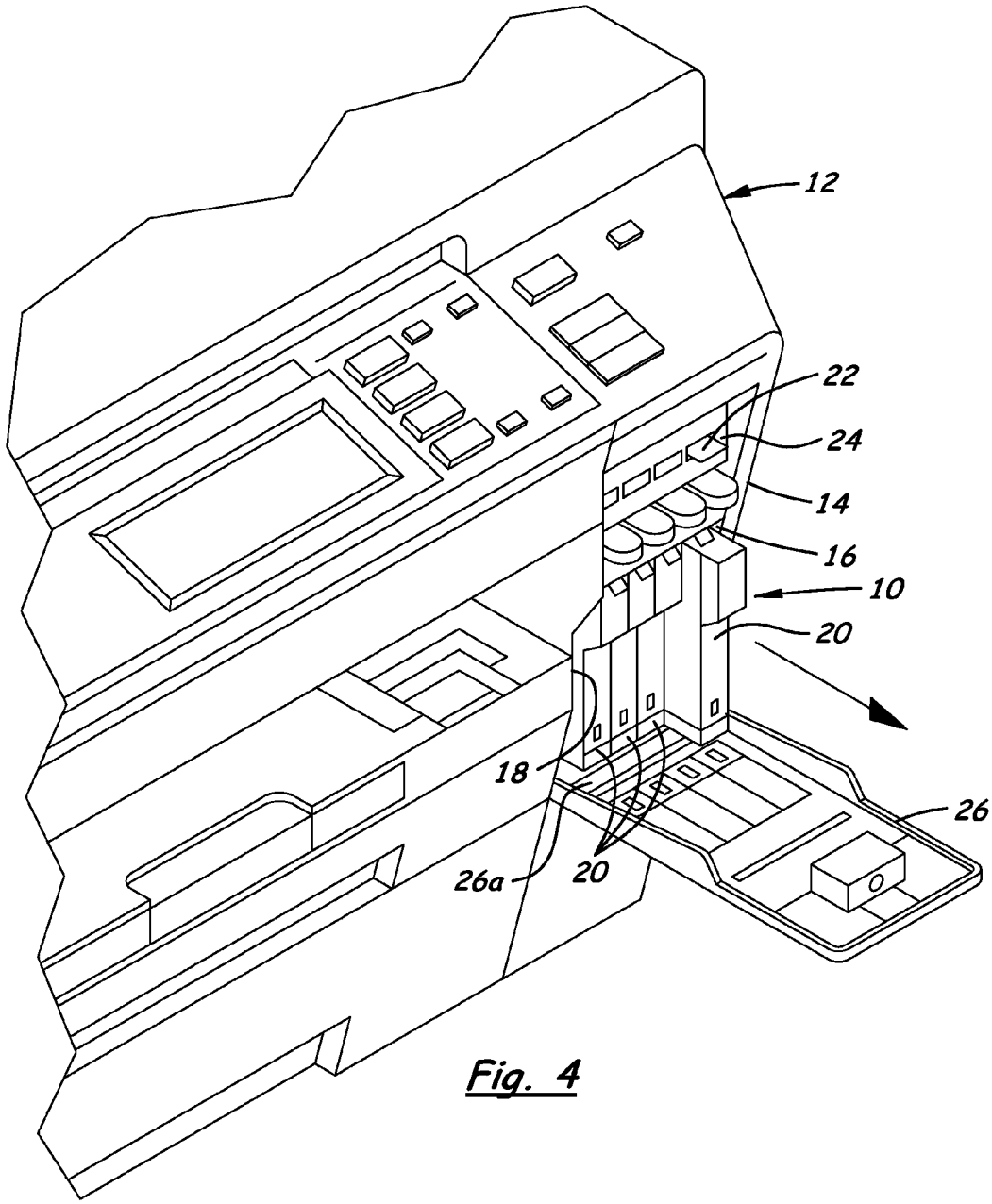

FIG. 4 is a perspective view of a printer employing an exemplary embodiment of the ink tank security system of the present invention, showing an ink tank access door in open position with one of the ink tanks being removed.

Figure 5:
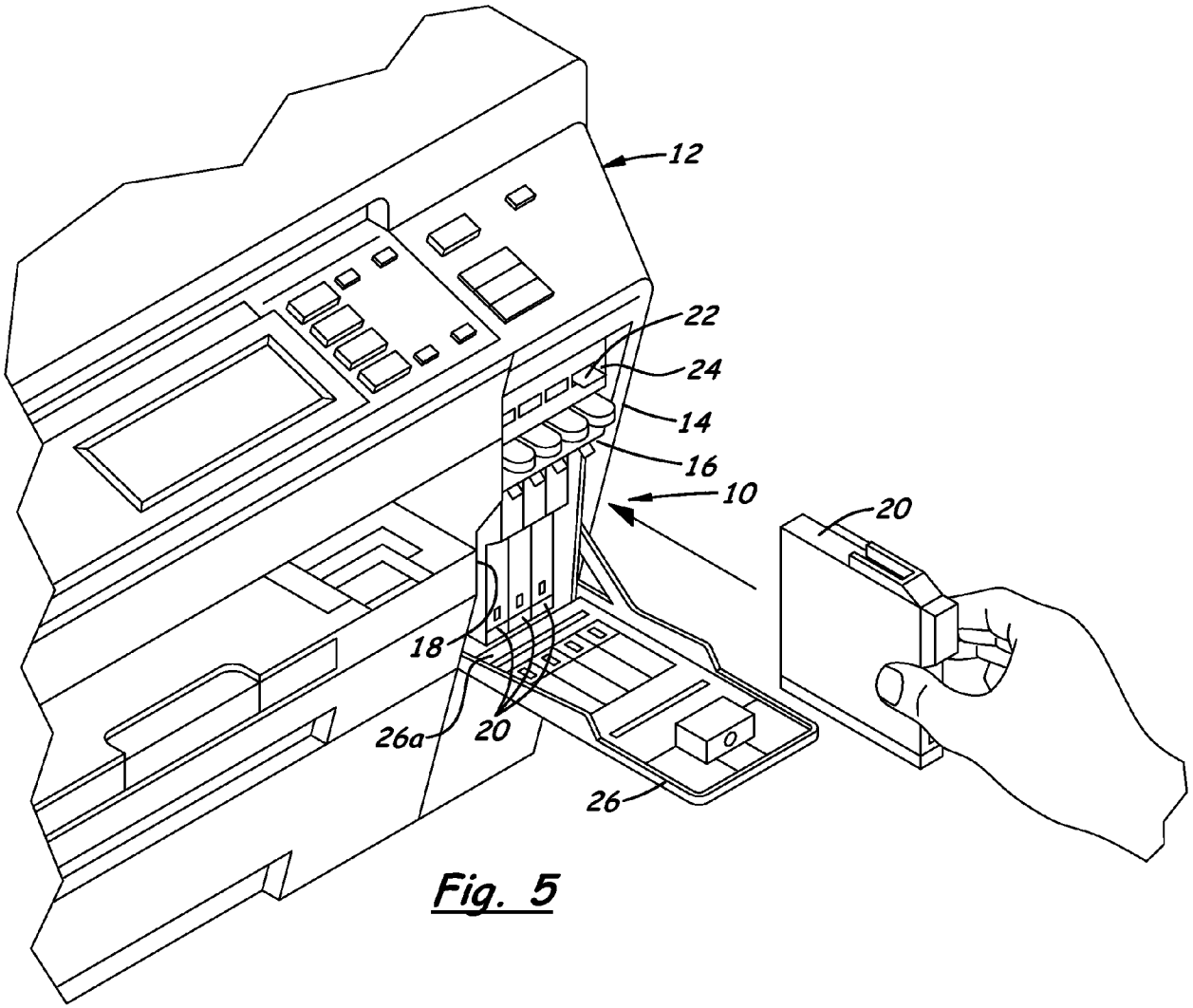

FIG. 5 is a perspective view similar to FIG. 4, now showing a replacement or refilled ink tank being installed on the printer.

Figure 6:
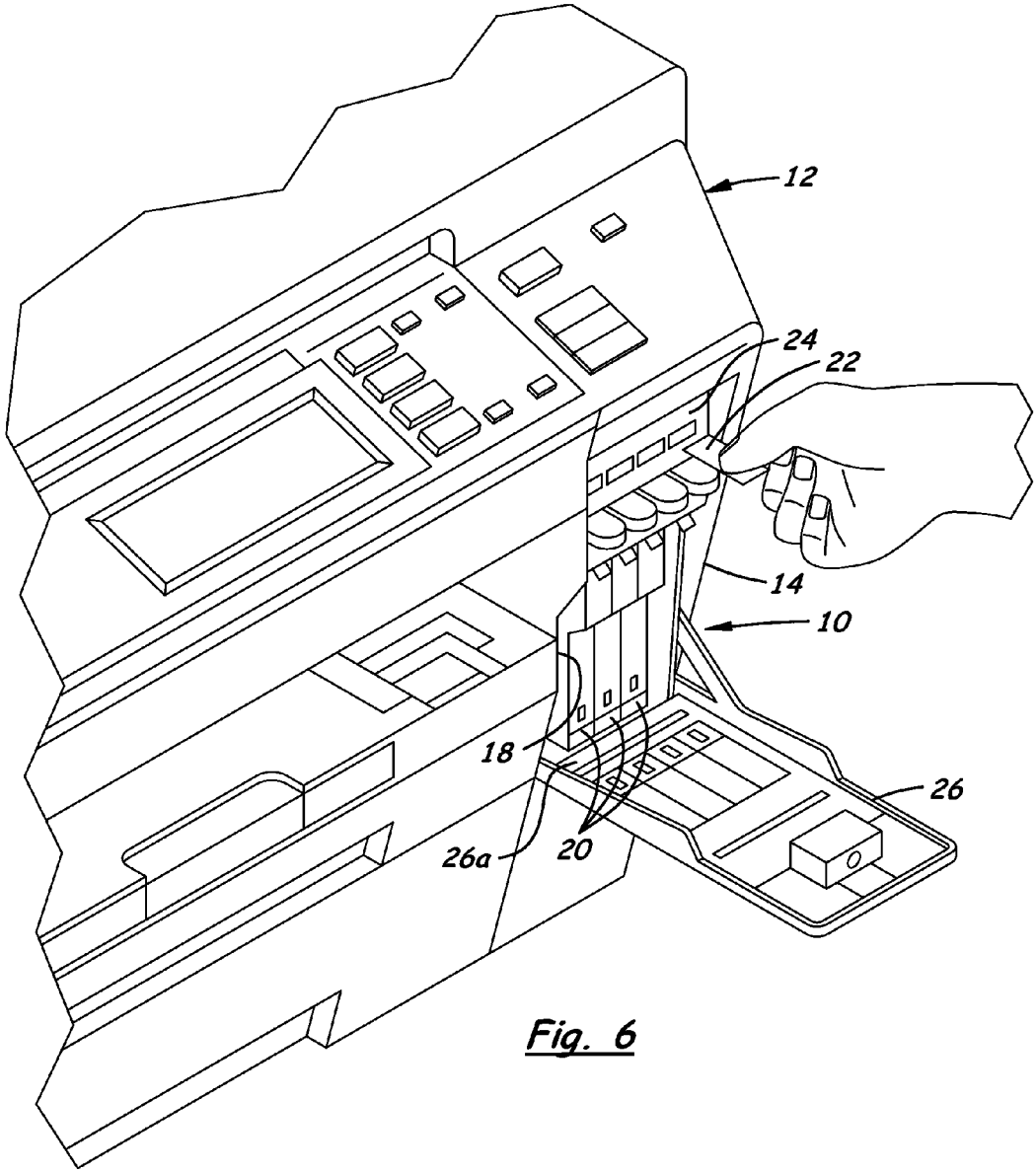

FIG. 6 is a perspective view similar to FIG. 4, now showing a security key being inserted into a slot on the main board of the printer.

Figure 7:
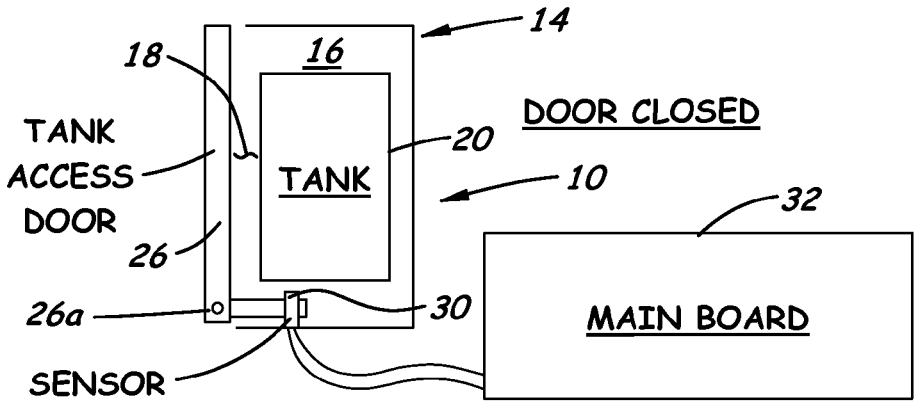

FIG. 7 is a schematic representation of an ink tank access door in a closed position with a sensor connected to a main board and set up to switch upon movement of the door from the closed to the opened position.

Figure 8:
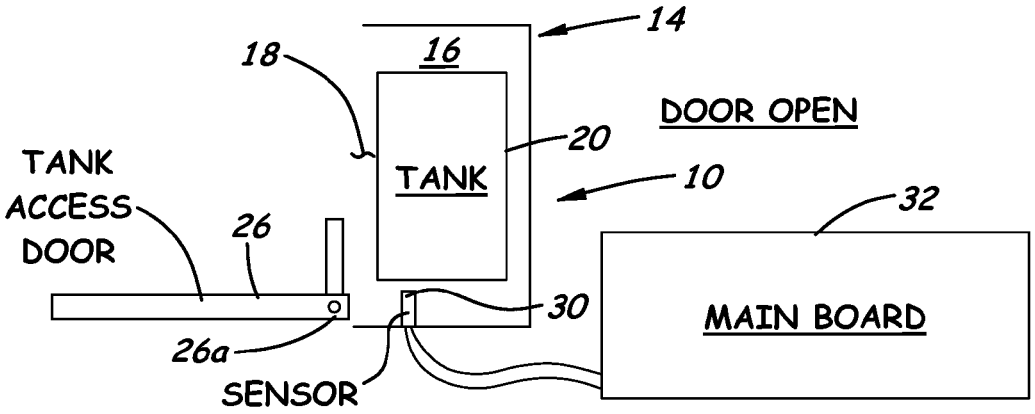

FIG. 8 is a schematic representation similar to FIG. 7, except now the access door has been moved to the opened position actuating the sensor in response to opening the door.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIGS. 4-6, there is illustrated an exemplary embodiment of an ink tank security system, generally designated 10, on a printer 12 in accordance with the present invention. The system 10 may be utilized with an imaging apparatus, such as an inkjet printer, as disclosed in U.S. Pat. Nos. 7,044,574 and 7,280,772, assigned to the same assignee as the present invention. The disclosures of these patents are hereby incorporated herein by reference thereto.

In FIGS. 4 and 5, the ink tank security system 10 on the printer 12 includes an ink tank connection station 14 having a cavity 16 with a passage 18 to the cavity 16. The passage 18 allows for insertion therethrough of one or more ink tanks 20, being typically when loaded with ink, into the cavity 16 in order to supply ink for printing operations of the printer. The passage 18 also allows for removal therethrough of the tank(s) 20, typically when depleted of ink, from the cavity 16 for replenishing with ink or replacement. The ink tank security system 10 also includes a security device 22, such as an integrated circuit alone or mounted on a PCB. The security device 22 is insertable into and removable from a given location, such as a control slot 24 on the printer 12. The security device 22 is employed to control re-use of the ink tank 20 for replenishing the supply of ink for printing operations by the printer 12. The control slot 24 in the exemplary embodiment is located under an ink tank access door 26.

For controlling access to the cavity 16 of the printer 12, the ink tank security system 10 includes the access door 26 pivotally mounted at one edge 26*a* to the printer 12 adjacent to the lower edge of the cavity 16. The access door 26 undergoes pivotal movement, in the manner depicted diagrammatically in FIGS. 7 and 8, between first and second displaced positions to open and close the passage 18 to the cavity 16 of the station 14.

For alerting the printer 12 that a tank 20 or a security device 22 is about to be moved, either into or from the printer station 14, the ink tank security system 10 further includes a switch or sensor (such as an opto-electronic type) 30 disposed adjacent to the access door 26, as seen in FIGS. 7 and 8, to sense movement of the door 26 between its respective displaced positions. The sensor 30 electrically communicates the detection of this movement to the printer 12. The sensor 30 functions as a switch notifying the printer 12 that a security device 22 is about to be moved, either into or from the printer station 14, or an ink tank 20 is accessible to be either inserted into or removed from the cavity 16 of the station 14. The controller (not shown) of the printer 12 is alerted and thus enabled to take various actions, such as suspension of communications prior to removal of the security device 22 and breaking of electrical contacts, to preserve data connected with the control function performed by the security device 22.

The system 10 provides a similar IC/PCB security device 22 as before, now shipped with but separate from the ink tank 20. This separate device 22 provides the same means to limit users from misusing the tank 20 by shutting down printing after, for example, a threshold dot count is reached. The system 10 allows flexibility as to where the device 22 is placed. This separate security device 22 can be thought of and designed like a 'key', which can be inserted into a location, such as the control slot 24, on the main board 32 (see also FIGS. 7 and 8), for instance, of the printer 12. This allows reduction of the cabling, lowering the cost of the system 10. It also may lower design cost of the security device 22 itself. For instance, the separate security device 22 (or chip) is likely to be inserted only once, whereas when mounted on the tank 20, when the device is attached on the tank, it might well be pulled and re-inserted several times. For the attached device, this means the PCB likely requires gold contacts. But with a separate security device, it may be possible to have the contacts be tin-lead or perhaps be a carbon-layer contact, effectively reducing the cost of the security device 22. Also, the tolerance of the connectors' mating to the chip/PCB of the security device is less tight and more easily manageable for the separate approach, which reduces the cost of the overall system. An additional benefit to the separate approach is reduced tank cost, since the tank need not go through operations to tightly control placement of a security device on it. Also, tank recycling is easier without security device removal and re-attachment.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. An ink tank security system in a printer, comprising:

an ink tank connection station on a printer having a cavity with a passage to said cavity for insertion and removal of at least one ink tank;

a door mounted adjacent to said passage to said cavity of said station for undergoing movement between first and second displaced positions opening and closing said passage to said cavity of said station;

a sensor disposed adjacent to said door and adapted to sense movement of said door between said first and second displaced positions corresponding opening and closing said cavity of said station and to provide notification to the printer of the movement of said door; and a security device separate from the ink tanks and insertable into and removable from a location on the printer to authenticate and control operation of said ink tank by said printer.

2. The system of claim 1 wherein said security device is an integrated circuit.

3. The system of claim 1 wherein said security device is an integrated circuit on a printed circuit board.

4. The system of claim 1 wherein said location of said security device is under said door.

5. The system of claim 1 wherein said location of said security device on the printer is a control slot on a panel thereof.

* * * * *